US005547042A

United States Patent [19]

Platt

[11] Patent Number: 5,547,042

[45] Date of Patent: Aug. 20, 1996

[54] CRANK CASE DRAIN PLUG STRUCTURE AND METHOD

[76] Inventor: Richard B. Platt, 381 Country Club La., Detroit, Mich. 48236

[21] Appl. No.: 377,009

[22] Filed: Jan. 23, 1995

[51] Int. Cl.[6] ..... F16C 3/14

[52] U.S. Cl. ..... 184/1.5; 138/89; 184/109

[58] Field of Search ..... 184/1.5; 138/89; 137/800

[56] References Cited

U.S. PATENT DOCUMENTS

| | | | |
|---|---|---|---|
| 3,967,697 | 7/1976 | Guenther | 184/1.5 |
| 4,503,934 | 3/1985 | Stephanus et al. | 138/89 |
| 4,938,314 | 7/1990 | Sitzler et al. | 184/1.5 |
| 4,951,723 | 8/1990 | Hoeptner, III | 184/1.5 |

FOREIGN PATENT DOCUMENTS

| | | | |
|---|---|---|---|
| 2620199 | 11/1977 | Germany | 184/1.5 |

*Primary Examiner*—Thomas E. Denion

[57] ABSTRACT

Improved drain plug structure and method for the oil pan of the crank case of an automobile engine of the like, which permits removal of the drain plug for draining oil from the oil pan without leaking of oil on tools or personnel. In accordance with the invention, a resilient sealing member is provided operably positioned in relation to the stem of the drain plug and the opening through the oil pan to prevent undesired leakage between the drain plug and oil pan during removal of the drain plug. In a preferred embodiment, the sealing member is a cylindrical, resilient disc of sealing material secured to the end of the stem of the drain plug. In a modification, the diameter of the sealing member is adjusted by placing a disc over the sealing member and compressing the sealing member between the disc and end of the stem of the drain plug. In further modifications, the sealing member is am annular band of O-ring in a groove around the inner end of the stem of the drain plug or may be a band or O-ring in the opening through the oil pan adjacent to the bottom thereof. In accordance with the method of the invention, a drain plug is provided with a sealing member on the inner end thereof operably positioned in relation to an oil pan and the drain plug during removal of the drain plug from the oil pan to seal between the oil pan and the drain plug. In modifications of the method, the sealing member is compressed to vary the diameter of the sealing member and/or is positioned in an annular groove about the end of the stem of the drain plug of in the opening in the oil pan which receives the drain plug.

20 Claims, 3 Drawing Sheets

CRANK CASE DRAIN PLUG STRUCTURE AND METHOD

BACKGROUND OF THE INVENTION

1. Field of the Invention

The invention relates to crank case oil pan drain plugs for automobile engines or the like, and refers more specifically to an oil pan drain plug including sealing means operable between the drain plug and the oil pan, on removal of the drain plug to drain oil from the oil pan, to prevent leakage of oil from the oil pan about the threads between the opening through the oil pan and drain plug, until the threads of the oil pan and the drain plug are disengaged, whereby the plug may be removed without leakage of oil on the tools used in or person removing the plug.

2. Description of the Prior Art

In the past, to remove a drain plug from the oil pan of an automobile engine or the like when draining and changing engine oil, after placing an oil collection pan under the crank case to receive the old oil, a wrench has generally been utilized to loosen and initially unscrew a bolt-like drain plug. Oil pan drain plugs of the past, as shown best in FIGS. 1 and 2, have usually had a threaded stem 13 which in use extends into the oil pan through a threaded opening in the oil pan, and a head 15 which extends exteriorly of the oil pan, shaped to facilitate operational engagement of a wrench with the drain plug head. After the initial loosening of the plug, the plug was usually unthreaded by hand. The plug was removed and the engine oil drained into the pan.

With such structure and method of the past, after a few turns of the plug, the oil began to leak out of the oil pan around the threads in the oil pan opening and on the drain plug and onto the tools and/or person removing the drain plug. At the very least, leaking oil is a messy nuisance, and sometimes it is hot enough to cause serious burns.

Such leakage also encourages the person removing the drain plug to hurry to complete the unscrewing and removal of the drain plug from the oil pan. This hurrying often results in dropping of the drain plug into the oil collection pan, requiring a messy search for the drain plug in the pan of, possibly hot, oil after the oil has been drained out of the engine into the oil collection pan.

Prior drain plug art for crank case oil pans has sometimes addressed these problems and has provided a variety of structures and methods for removal of oil from a crank case when it is desired to change the oil which partially alleviate these problems.

Such structure is shown in U.S. Pat. Nos. 1,804,960 and 4,231,544, both of which show special valves in conjunction with the usual drain plug opening in a vehicle oil pan that prevent undesired leakage. Note, however, that both of these patents require a complete new drain plug which is complicated to manufacture in comparison to the usual prior art drain plug 11 and is therefore expensive. Also, both of these drain plugs have operative parts extending below the engine oil pan which are subject to damage during use of the vehicle. In addition, they require the installation of an exteriorally threaded cylinder into the usually interiorally threaded opening in the crank case oil pan, which cylinder typically extends upward into the oil pan, thereby prohibiting the complete drainage of the old oil.

Other such structure is shown in the U.S. Pat. Nos. 5,299,777 and 5,326,071. These patents again teach drain plugs and methods which utilize the existing oil pan drain opening. However, both of these structures require special tools to actuate to permit draining of crank case oil. Also, they are again relatively complicated and therefore expensive.

Additional prior art structure is shown in U.S. Pat. Nos. 3,097,663 and 3,869,391. These patents do not prevent leakage as the drain plug is loosened to permit drainage of crank case oil from the oil pan, and both appear to require installation with the crank case oil pan at the time the pan is manufactured. They are again relatively complicated and therefore expensive to manufacture.

Thus, prior art has recognized the problem of leakage during drainage of oil from a crank case (see especially Pat. No. 5,326,071), and some have provided structures which will prevent messy leakage around a drain plug while it is being removed to drain oil from the crank case. However, such structures and methods of the past as shown in the patents listed above are complicated, so are expensive to produce. Further, in some instances, the prior art structures extend below the crank case oil pan by which they are carried, and are thus subject to damage, or require original equipment installation with the crank case oil pan and therefore are not suitable for aftermarket sales, or extend into the crank case oil pan resulting in incomplete drainage.

OBJECTS OF THE INVENTION

It is therefore an object of the invention to provide a drain plug for a crank case oil pan of an internal combustion engine or the like which is simple in construction, economical to manufacture and efficient in use, which may be installed and removed in an existing crank case oil pan drain opening without leakage during removal.

It is a further object of the invention to provide a drain plug for the crank case oil pan of an internal combustion engine including sealing means between the oil pan and drain plug which will prevent leakage between the drain plug and oil pan during removal of the drain plug.

Another object of the invention is to provide a method of removing a drain plug from the crank case oil pan of an automobile without producing leakage between the drain plug and oil pan prior to complete removal of the drain plug from the oil pan.

SUMMARY OF THE INVENTION

In summary, the present invention comprises a drain plug structure for and method of draining oil from the crank case oil pan of a vehicle engine or the like without leakage of oil prior to the complete removal of the drain plug from the oil pan to prevent soiling or contamination of tools or the hand and arm and/or clothing of a person removing the drain plug by oil leaking between the threads of the drain plug and the opening for the drain plug through the oil pan.

In accordance with the preferred embodiment of the invention as shown in FIG. 3, the usual drain plug for a crank case oil pan is provided with a sealing member extension on the end thereof which may be elastic or resilient and which, in operation in accordance with the method of the invention, seals between the plug and crank case oil pan as the drain plug is removed from the oil pan until the mating threads of the drain plug and opening through the oil pan are disengaged, after which the plug must be pulled from the opening before oil is leaked or drained therefrom.

In accordance with a modification of the invention, as shown in FIG. 7, a disc is positioned on the sealing member so that the sealing member is between the end of the drain plug and the disc. The disc is held in place by means of a small bolt, which as it is tightened can adjust the outer diameter of the sealing member to insure a seal between the plug and crank case oil pan opening as the plug is withdrawn from the oil pan. Alternatively, in this modification, a stem, integral with the disc, can be press fit into an opening in the end of the drain plug to provide desired compression of the sealing member between the disc and end of the drain plug.

In another modification of the invention, as shown in FIG. 8, an annular groove is made around the end of the stem of the drain plug and a sealing O-ring or band of resilient material is placed in the annular groove to seal between the opening in the crank case oil pan and the drain plug as the drain plug is removed from the oil pan. In this modification, the threads are removed from at least one of the inner end of the stem of the drain plug and the outer end of the opening through the oil pan to permit rapid withdrawal of the drain plug from the oil pan on disenegagement of the threads on the drain plug and opening through the oil pan.

In a still further modification of the invention, as shown in FIG. 9, an annular internal recess may be provided around the lower end of the opening through the crank case oil pan and a resilient sealing member positioned within the recess to seal between the drain plug and the opening through the oil pan on withdrawal of the drain plug from the opening through the oil pan. Again, the threads are removed from at least one of the lower end of the opening through the oil pan and the inner end of the drain plug to permit rapid removal of the drain plug from the opening through the oil pan on the threaded portions thereof being disengaged.

DETAILED DESCRIPTION OF THE PREFERRED EMBODIMENTS

Figure 1:
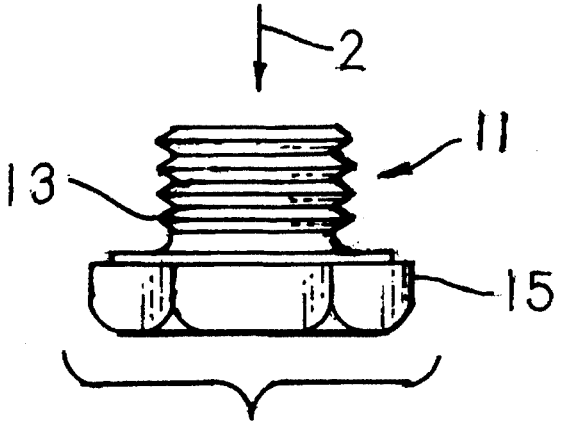
FIG. 1, is a side view of a prior art crank case oil pan drain plug.
Figure 2:
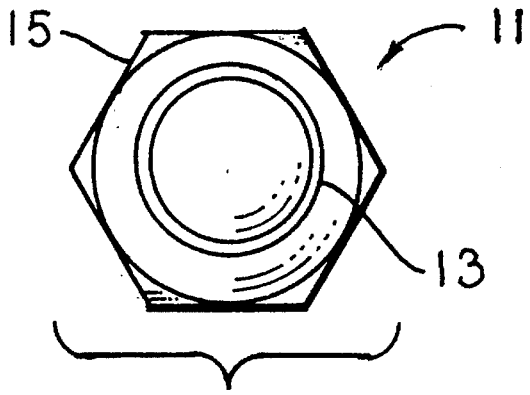
PRIOR ART Fig. 2
FIG. 2, is an end view of the prior art drain plug shown in FIG. 1, taken in the direction of arrow 2 in FIG. 1.
Figure 3:
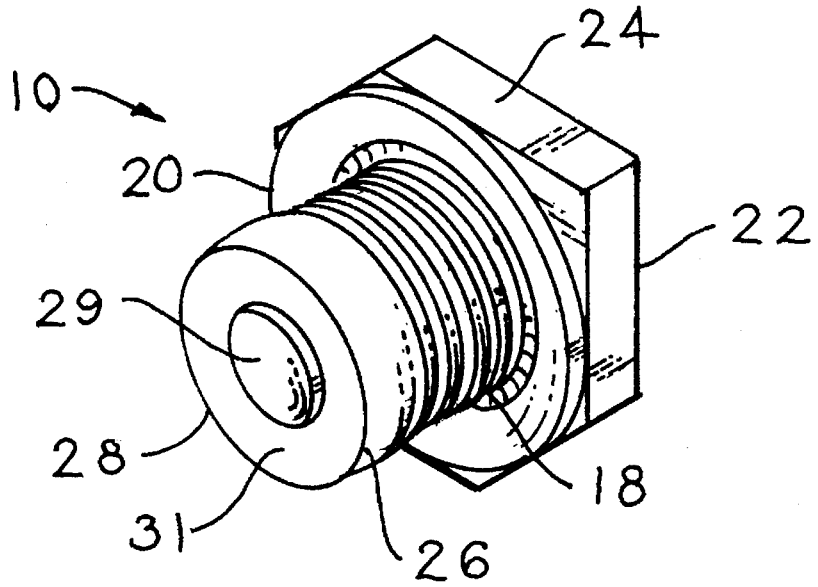
PRIOR ART Fig. 3
FIG. 3, is a perspective view of an improved oil pan, drain plug constructed in accordance with the structure and method of the invention.
Figure 4:
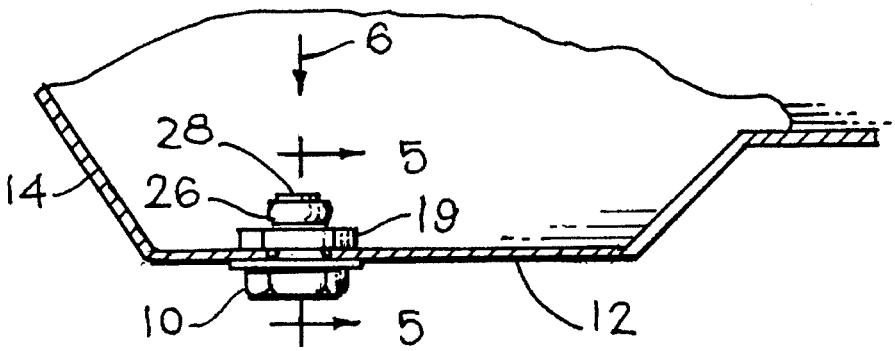
FIG. 4, is a partially broken away view of a portion of the bottom of the oil pan of the crank case of an automobile engine or the like showing the drain plug of FIG. 3 installed in an opening in the lowermost portion of the oil pan for drainage of oil in the crank case on removal of the oil pan drain plug.

In more detail, a drain plug 10, shown best in FIG. 3 of the drawings, constructed in accordance with the invention for performing the method of the invention, is shown in FIG. 4 installed in the lowermost portion 12 of a crank case oil pan 14 of an internal combustion engine (not shown in further detail). The lowermost portion 12 of the oil pan 14 including nut 19 welded thereto, has a threaded opening 16, shown best in FIG. 5, extending therethrough in which the drain plug 10 is installed.

Figure 5:
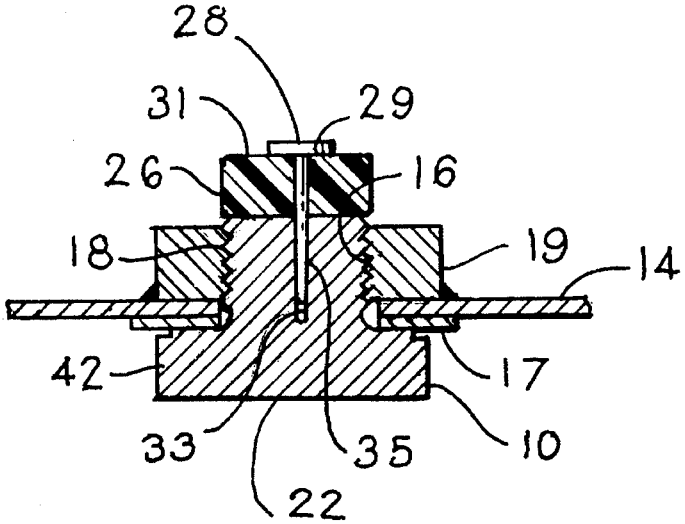
FIG. 5, is an enlarged section view of the installed crank case oil pan drain plug shown in FIG. 4, taken substantially on the line 5—5 in FIG. 4.
Figure 6:
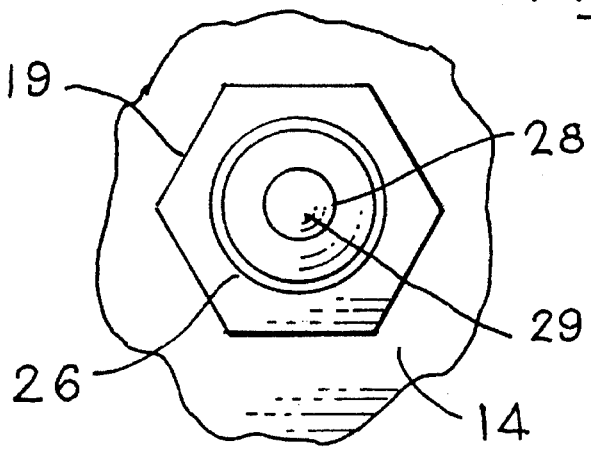
FIG. 6, is an enlarged partial end view of the installed drain plug shown in FIG. 4, taken in the direction of arrow 6 in FIG. 4.

The drain plug 10 as shown in detail in FIGS. 3 and 5 includes a threaded stem portion 18 having a stem inner end portion 20. The drain plug 10 further includes a head portion 22, which as shown best in FIG. 3, is provided with a hexagonal peripheral configuration 24 to permit engagement of the head portion 22 by a wrench or the like, for initial loosening of the drain plug from the oil pan 14.

With the drain plug as thus described, when it is desired to drain oil from an oil pan 14, the drain plug is loosened as by means of a wrench on the peripheral surface 24 of The head 22. After initial loosening, the drain plug is removed generally by unthreading the drain plug from the opening 16 by hand.

As indicated above, with the usual drain plug of the prior art 11, as the drain plug is loosened, oil (not shown) from the oil pan leaks between the threads of the drain plug stem and the threaded opening in the oil pan and may run off the drain plug onto the tool hand, arm and/or clothes of the person removing the plug. Such leakage is messy and, if the oil is hot, may be dangerous.

Accordingly, after leaking begins, the person removing the prior art drain plug generally attempts to hurry in unscrewing the drain plug, and in their hurry often drops the drain plug into a used oil collection pan positioned beneath the opening in the oil pan to receive oil draining from the oil pan when the drain plug is removed. Loss of the drain plug into the oil collection pan requires another messy procedure, such as fishing around in the pan either by hand or with a tool to regain the drain plug for replacement before the oil in the crank case may be replenished.

In order to prevent the undesired leakage during removal of the drain plug 10, in accordance with the invention, a sealing member 26 is positioned on the inner end 20 of the stem portion 18 of the drain plug 10. The sealing member 26 is held in place by means of a retaining member 28, shown best in FIG. 5.

The retaining member 28, as shown best in FIG. 5, has a head 29 engaging the outer surface 31 of the sealing member and an integral stem 33 extending into the opening 35 in the end 20 of the stem portion 18 of the drain plug 10. The stem 33 of the retaining member 28 is a press fit in the opening 35 to retain the sealing member 26 on the drain plug 10.

The sealing member 26 is elastic or resilient and may be made of Neoprene, rubber or the like, possessing suitable wear resistance and resistance to exposure to hot oil.

Again, in accordance with the method of the invention, as the drain plug 10 is removed, the sealing member seals between the drain plug 10 and the opening 16 to prevent any leakage therebetween until the threads on the stem 18 of the drain plug 10 and in the opening 16 through the oil pan 12 are disengaged. Following disengagement of the threads, the drain plug 10 may be pulled sharply from the opening 16 prior to leakage and/or draining of oil.

As shown in FIGS. 3–6, the sealing member 26, in order to perform its sealing function, has a diameter at least as great as the minimum diameter of the threads on the stem 18.

It will be understood that the height of the stem portion 18 of the drain plug 10 above the interior surface of the lower portion 12 of the crank case 14 at the opening 16 therethrough must not be so great so that on loosening of the drain plug 10, the oil from the crank case 14 will leak past the threads on the drain plug 10 and in the opening 16 prior to the sealing member 26 sealing between the drain plug 10 and the oil pan 14. Accordingly, an existing drain plug 11 may need to be modified to alter the length of the stem which would extend above the inner surface of the lowermost portion 12 of the oil pan 14.

Also, an existing drain plug 11 will need to be modified to receive the retaining member 28, as by providing an opening 35 therein.

Figure 7:
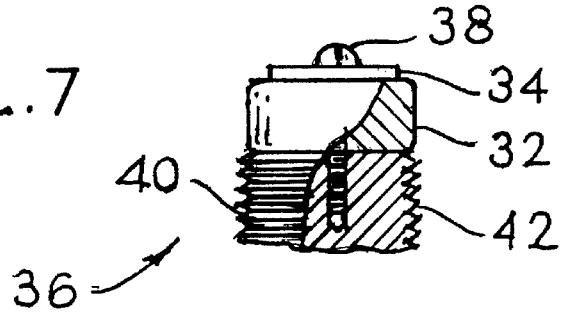
FIG. 7, is a partial section View of a modification of the oil pan drain plug of the invention, similar to a portion of FIG. 5, showing structure for varying the compression of the sealing member to adjust its diameter.

In the modified drain plug 36 of FIG. 7, an annular disc 34 is positioned on the sealing member 32 and is secured to the stem 40 of the plug 36 by a small bolt 38. In other respects, the modified drain plug 36 may be the same as drain plug 10.

With the modified drain plug structure 36 shown in FIG. 7 the outer diameter of the sealing member 32 may be slightly adjusted with the bolt 38 by applying pressure thereto through the disc 34 longitudinally of the bolt 38 on tightening of the bolt, due to the resiliency of the sealing member 32. The sealing member 32 will tend to expand radially due to pressure from the disc 34 on tightening of the bolt 38. Again, to effect the desired sealing, the ultimate diameter of the sealing member 32 must be at least as great as the minimum diameter of the threads 40 on the stem portion 42 of the drain plug 36.

The modified drain plug 44 shown in FIG. 5 includes an annular groove 46 about the inner end portion 56 of the stem 48 and an annular resilient sealing member 50 in the form of a band positioned within the groove 46. The outer or larger diameter of the annular sealing member 50 again must be at least as large as the minimum diameter of the threads 59 on the stem portion 48 of the drain plug 44 to effect a seal between the stem 48 and the threaded opening 52 through the oil pan 54.

Figure 8:
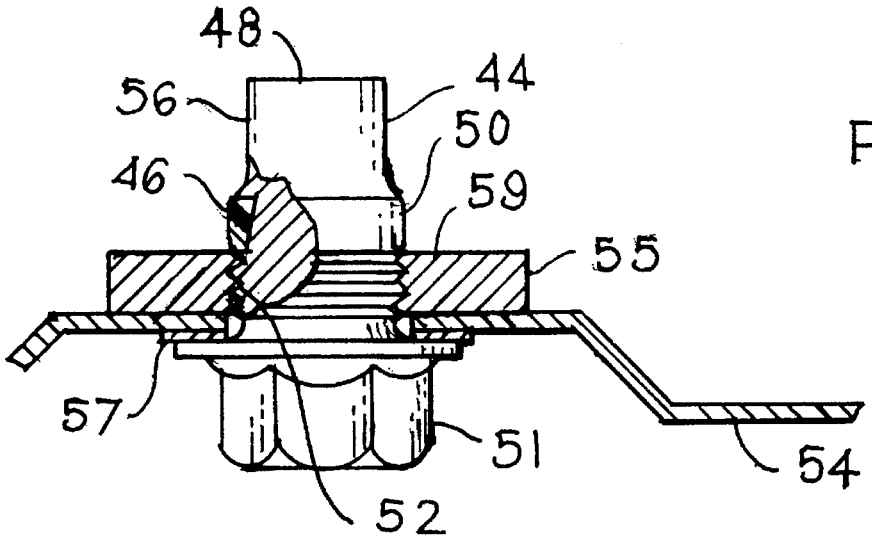
FIG. 8, is a partly broken away section view of another modification of the structure in FIG. 5, showing modified sealing structure between a drain plug and oil pan.

As shown in FIGS. 5 and 8, in manufacture of the oil pans 14 and 54, threaded nuts 19 and 55 are welded or otherwise secured to the inner surface of the bottom of the oil pans over the openings therethrough to provide threads in the openings 16 and 52 and maintain an economical thickness of the metal in the oil pans. Also in assembly, sealing washers 17 and 57 are placed between the heads 22 and 51 of the drain plugs 10 and 44 and the bottoms of the oil pans.

To permit removal of the drain plug 44 rapidly, after the threads on the stem portion 48 of the drain plug 44 and in the opening 52 through the oil pan 54 are disengaged, at least one of the threads at the inner end 56 of the stem 48 of the drain plug 44 and the threads at the outer end 58 of the opening 52 through the crank case 54 must be removed.

Thus, in operation of the drain plug 44, the drain plug is again loosened with a tool and unthreaded by hand with the sealing member 50 sealing between the drain plug 44 and the oil pan 54 until the threads are disengaged, at which time the sealing member still sealing between the drain plug 44 and the crank case 54 will permit rapid, easy withdrawal of the drain plug from the opening 52 prior to leakage or draining of oil from the oil pan 54 through the opening 52.

Figure 9:
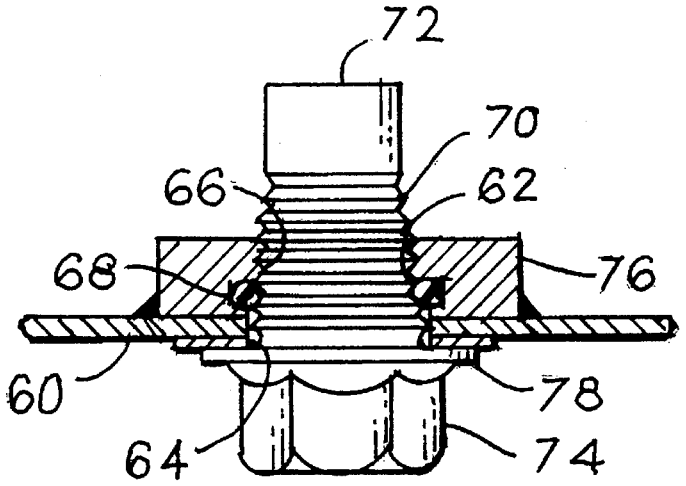
FIG. 9, is still another section view similar to the section view of FIG. 5, showing still another modified sealing structure between a drain plug and oil pan.

In a still further modification of the invention, as shown in FIG. 9, the oil pan 60 is modified by providing an internal annular groove 62 about the outer end 64 of the opening 66 therethrough, and resilient O-ring sealing member 68 is positioned therein. Again, the threads are removed from at least one of the outer end 70 of the stem 72 and the inner end 64 of the opening 66 as shown in FIG. 9 to permit rapid withdrawal of the drain plug 70 on disengagement of the threads on the stem 72 of the drain plug and the threads in the opening 66 in the oil pan 60, as before.

As shown in FIG. 9, the threaded member 76 secured to the oil pan 60 over opening 64 need not be a bolt, but may be any shaped member constructed of metal, plastic, etc., having a threaded opening 66 therethrough with suitable strength and durability when exposed to hot oil. Also, the head 74 of the drain plug 70 as shown in FIG. 9 includes a larger diameter portion 78, which is concave looking from end 72 of the drain plug 70 to aid in sealing between the drain plug 70 and oil pan 60 with the plug installed in the pan.

While one embodiment of the invention has been disclosed in detail and modifications thereof suggested, it will be understood that all embodiments and modifications as are defined by the appended claims are intended to be included within the scope of the invention.

What is claimed is:

1. An oil pan having an oil drain opening therethrough in a lower portion thereof having internal threads therein, an oil pan drain plug including a stem portion having external threads thereon and a head on one end of the stem portion adapted to facilitate screwing of the drain plug into and out of the opening through the oil pan and a sealing member secured to one of the oil pan within the opening therethrough and the drain plug stem immediately adjacent one end of the threads of the one of the oil pan within the opening therethrough and the drain plug stem which sealing member has a sealing diameter immediately adjacent another end of the threads which it is immediately adjacent to which is one of equal to or greater than the smallest diameter of the internal threads in the opening through the oil pan and equal to or greater than the smallest diameter of the external threads on the stem of the drain plug of the at least one of the opening through the oil pan and the stem of the drain plug.

2. Structure as set forth in claim 1, and further including specific structure for securing the sealing member to the other end of the drain plug stem portion comprising, an axially extending opening in the end of the stem portion of the drain plug and a fastener having a stem portion, one end of which is adapted to fit within the opening in the end of the stem portion of the drain plug and a radially extending head portion on an other end of the fastener stem portion engaging the sealing member with the stem portion of the fastener extending centrally through the sealing member and the one end of the stem portion fit within the opening in the stem portion of the drain plug.

3. Structure as set forth in claim 2, wherein the opening in the stem portion of the drain plug is threaded and the one end of the stem portion of the fastener is threaded, and the diameter of the head portion of the fastener is substantially the same as the inner diameter of the threads on the stem portion of the plug, whereby the diameter of the sealing member may be adjusted by adjusting the position of the head of the fastener relative to the one end of the stem of the drain plug with the sealing member positioned between the one end of the stem portion of the drain plug and the head portion of the fastener.

4. Structure as set forth in claim 1, and further including an annular recess in the stem portion of the drain plug immediately adjacent the other end thereof and wherein the sealing member is annular and is positioned within the recess.

5. Structure as set forth in claim 4, wherein threads between the annular recess on the stem portion of the drain plug and the other end of the drain plug are removed.

6. Structure as set forth in claim 1, and further including an annular recess in the opening through the oil pan adjacent an outer end of the opening and wherein the sealing member is an annular member positioned within the annular recess.

7. Structure as set forth in claim 6, wherein the threads in the opening through the oil pan are removed from the annular recess to the outer end of the opening.

8. Structure as set forth in claim 1, wherein the sealing member is one of a resilient band and an elastic O-ring.

9. A drain plug comprising a cylindrical stem portion having threads thereon which threads have a minimum and maximum diameter, a head portion on one end of the stem portion adapted to engage a tool, and a sealing member secured to the stem portion of the drain plug immediately adjacent an other end of the stem portion having a sealing diameter, immediately adjacent the other end of the stem portion of the drain plug, which sealing diameter is equal to or greater than the smallest diameter of the threads on the stem of the drain plug.

10. Structure as set forth in claim 9, wherein the sealing member is a flat disc, and further including an axially extending opening in the other end of the stem portion of the drain plug, a fastener having a fastener stem portion, one end of which fastener stem portion is adapted to be inserted in the opening in the other end of the stem portion of the drain plug, a radially extending head portion on the other end of the stem portion of the fastener engageable with the sealing member to hold the sealing member in engagement with the other end of the drain plug with the stem portion of the fastener extending centrally through the sealing member and the one end of the stem portion of the fastener inserted in the opening in the other end of the stem portion of the drain plug.

11. Structure as set forth in claim 10, wherein the opening in the other end of the stem portion of the drain plug and the one end of the stem portion of the fastener have mating threads and the head portion of the fastening member is only slightly smaller in diameter than the sealing member immediately adjacent the other end of the stem portion of the drain plug, whereby on screwing the one end of the fastener member into and out of the opening in the other end of the stem portion of the drain plug with the head portion of the fastener in engagement with the sealing member, the diameter of the sealing member immediately adjacent the other end of the stem portion of the drain plug is adjusted.

12. Structure as set forth in claim 9, and further including an annular recess in the stem portion of the drain plug immediately adjacent the other end of the stem portion of the drain plug and the sealing member is positioned within the annular recess.

13. Structure as set forth in claim 12, wherein threads of the stem portion between the annular recess and the other end of the stem portion of the drain plug are removed.

14. A method of draining an oil pan, comprising making an internally threaded opening through a lower portion of the oil pan, providing an oil pan plug having a threaded stem and a tool-engageable head on one end of the stem, securing a sealing member, immediately adjacent another end of the threads on one of the oil pan in the opening through the oil pan and the stem of the oil pan plug, having at least one of an outer diameter at least as large as a minimum diameter of the threads on the stem of the drain plug and a maximum diameter at least equal to a minimum diameter of the threads in the opening, immediately adjacent the end of the threads which the sealing member is at the end of, screwing the oil pan plug into the threaded opening through the oil pan to retain oil in the oil pan and unscrewing the oil pan plug to disingage the threads on the drain plug stem from the threads in the opening through the oil pan and pulling the drain from the opening when it is desired to drain oil from the oil pan without leakage of oil prior to pulling the drain plug from the opening.

15. The method as set forth in claim 14, wherein the sealing member is a flat disc secured to the other end of the stem portion of the oil pan plug and the securing of the disc to the other end of the stem portion of the oil pan plug includes the steps of providing an axially extending opening in the other end of the stem portion of the oil pan plug, providing a fastener having a fastener stem portion, one end of which is adapted to be inserted in the opening in the other end of the stem portion of the oil pan drain plug, and providing a generally flat radially extending head portion on the other end of the stem portion of the fastener engageable with the sealing member to hold the sealing member in engagement with the other end of the drain plug and inserting the stem portion of the fastener member centrally through the sealing member into the opening in the other end of the plug stem until the head portion of the fastener engages the sealing member.

16. The method as set forth in claim 15, and further including the steps of providing mating threads in the opening in the other end of the stem portion of the drain plug and on the stem portion of the fastener and providing the head portion of the fastener with a diameter only slightly smaller than the outer diameter of the sealing member, and further including the step of adjusting the outer diameter of the sealing member by screwing the fastener stem portion into or out of the opening in the other end of the drain plug.

17. The method as set forth in claim 14, and further including creating an annular recess on the plug stem adjacent the other end of the plug stem, and placing the sealing member in the annular recess.

18. The method as set forth in claim 17, and further including the step of removing the threads on the stem of the plug between the annular recess and the opposite end of the plug stem.

19. The method as set forth in claim 14, and further including the steps of producing and annular internal recess adjacent the outer end of the opening through the oil pan and positioning the sealing member within the recess.

20. The method as set forth in claim 19, and further including the step of removing the threads from the outer end of the opening through the oil pan between the recess and the outer end of the opening through the oil pan.

* * * * *